US005298837A

United States Patent [19]

Diestl

[11] Patent Number: 5,298,837

[45] Date of Patent: Mar. 29, 1994

[54] ULTRAVIOLET FLASH DRYER

[75] Inventor: Bedrich Diestl, Union City, Calif.

[73] Assignee: Online Energy, Inc., Dublin, Calif.

[21] Appl. No.: 949,032

[22] Filed: Sep. 22, 1992

[51] Int. Cl.[5] ..... H05B 37/00

[52] U.S. Cl. ..... 315/289; 315/290; 315/292; 315/293; 315/311; 315/224; 315/240; 315/244

[58] Field of Search ..... 315/289, 290, 244, 240, 315/224, 311, 292, 293

[56] References Cited

U.S. PATENT DOCUMENTS 3,911,318 10/1975 Spera et al. ..... 315/39
4,359,668 11/1982 Ury ..... 315/244
4,721,888 1/1988 Proud et al. ..... 315/289 X
4,890,041 12/1989 Nuckolls et al. ..... 315/244 X

*Primary Examiner*—Robert J. Pascal

*Assistant Examiner*—Haissa Philogene

*Attorney, Agent, or Firm*—Bielen, Peterson & Lampe

[57] ABSTRACT

A quick start ultraviolet emission unit with an elongated, electrode-type, mercury-filled, arc lamp having spaced end electrodes connected to an electrical power supply that connects to an alternating current power source and to each end electrode of the arc lamp for powering the lamp with an alternating current having a sinusoidal cycle, the unit includes a pulse generating, circuit means connected to said power supply for generating a high current, high voltage, electrical pulse added to the alternating current to the lamp during start-up and restart and a trigger circuit connected to the pulse generating circuit for triggering generated high current, high voltage electrical pulses at the peak potential in the sinusoidal cycle of the alternating current form the power supply.

9 Claims, 2 Drawing Sheets

ULTRAVIOLET FLASH DRYER

BACKGROUND OF THE INVENTION

This invention relates to a quick starting ultraviolet or UV emission unit that incorporates a novel electronic circuit to reduce the start-up phase to several hundred milliseconds. Additionally, the novel electronic circuit enables variations in output power from a minimum sustaining power to maximum output in discrete selectable steps. these features enable the UV unit to be particularly applicable to environments where initial start, shutown and restart of the UV emission are devised to be virtually instant.

Ultraviolet (UV) energy is widely used in many manufacturing processes, ranging from drying of inks, coatings and adhesives in paper, wood, metal, plastics, fiber optics, etc. to sterilization and disinfection of pharmaceutical products and treatment of waste waters.

The most common source of ultraviolet radiation is the electrode type mercury filled arc lamp. This is a quartz tube, filled with a inert gas (argon or xenon), and two electrodes, one at each end, which are connected to an appropriate power source. At room temperature the mercury enclosed in the lamp is in the liquid state. When an arc is applied to the electrodes, the enclosed inert gas is ionized and the lamp temperature rises causing evaporation of the mercury. Further electrical discharge through the mercury vapor produces a mercury plasma that discharges electromagnetic radiation in a wide band ranging from the lower UV to the INFRA-RED regions of the electromagnetic spectrum.

The time necessary to evaporate all the mercury within the lamp and to bring the mercury vapor to the correct operating pressure, is called the "warm-up" period. In the conventional lamp, this time can be as long as 5 minutes and in more modern systems it has been reduced to 45 seconds, is the state-of-the-art of today's commercial systems.

Once the electrode UV lamp is turned off, the impedance of the "hot" lamp is such that the lamp cannot be restarted until the mercury re-condenses, which requires cooling the lamp envelope toward room temperature, until the impedance is low enough for an arc to strike between the electrodes. The time required is called "restart time" and is typically of the order of 2 to 10 minutes.

The net result of these two characteristics (warm-up and restart), is that it is impractical to shut-off a electrode UV lamp during routine operation, every time the product stops underneath the lamp. Continuous impingement of the energy on a product that is not moving, will cause rapid increases of the temperature of the target, leading to distortion or burning of the product. This difficulty is overcome by the use of "shutters". Shutters mechanically block the energy of the lamp from the product when the process stops, and allow for immediate irradiation when production resumes.

UV systems with shutters pose serious limitations to decreasing the ultimate size of the irradiator. Size is important in many applications, but critical in printing press applications where the space between print stations is always limited. Furthermore, shutters introduced a mechanical complication which results in unreliability and added cost.

An electrodeless lamp, excited by microwaves to overcome the start-up/cool-down cycle of the electrode type lamp is disclosed in U.S. Pat. No. 3,911,318.

The original lamp, which in practice was limited to a maximum of 10 inches of length, still had undesirable start-up characteristics. This type of lamp and its start-up time was improved by further enhancements as disclosed in U.S. Pat. No. 4,359,668. Even today, the start-up cycle is of the order of 2 to 4 sec with restart taking 10 seconds.

Other attempts at improving the start-up cycle of electrode type lamps, have been made and consist of adding a "third" wire to the outside of the lamp. As voltage is applied to the electrodes, high voltage pulses are applied to this wire, which is wrapped on the outside of the quartz tube, causing a faster ionization of the filler gas and thereby decreasing the start-up time. Commercial approach, and such systems are indistinctively referred to as "rapid start" dryers. Their actual starting times are of the order of 5 to 10 seconds.

A special electrical system, must be used to operate the electrode type mercury lamp. The lamp requires high voltage to initiate the arc and lower voltage to sustain it while it is operating. Since the mercury vapor tube has a voltage/current characteristic which is negative and non-linear, they require a constant wattage, ballast-type power supply. This power supply consists of a step-up transformer with a capacitance load. The lamp is connected in series to the secondary of the transformer. Once the lamp starts, the predominantly positive series impedance provides constant power and prevents the increasing current from destroying the lamp and the power supply. Once stabilized, the voltage across the lamp electrodes remains fairly constant and at a value lower that the open circuit voltage of the step-up transformer.

Once the lamp is in operation, it is convenient to be able to vary the power output, to match the speed of the commercial process to conserve energy and prevent excess heat built-up on the product. This is done by switching series capacitance in the power supply. Due to the high voltages and voltage transients involved in this switching process, mercury relays are conventionally used.

The quick starting ultraviolet emission unit of this invention substantially improves the operating characteristics in starting, restarting and regulating the output during operation. The unit accomplishes these desirable objectives inexpensively and in a manner allowing a compact size, often critical to installation in many environments.

SUMMARY OF THE INVENTION

The quick starting UV emission unit of this invention utilizes standard commercially available electrode-type mercury lamp and incorporates such a lamp in an electronic circuit for instant starting, including restart, and for stepped variation.

On a standard "transformer/capacitor" type of power supply, when power is applied to the UV Lam,, the voltage across it climbs towards the open circuit value until ionization of the starting gas occurs. As the lamp warms up, the plasma changes from that of the starting gas to a constricted mercury arc. The voltage slowly decreases while the current rises, following a well defined load line. The ultimate voltage is determined by the lamp characteristics.

In the subject invention, the start-up phase of a conventional UV electrode-type mercury lamp is reduced from as long as two minutes to several hundred milliseconds.

The invented system utilizes a new power supply combination uses a specially designed high voltage pulse transformer, that dispenses with a high resistance ballast or the inertial impedance of a metal core. Preferred is a high voltage pulse transformer with a floating secondary output and an air gap between primary and secondary windings. The transformer for most configurations has a step-up ratio of 20:1. A high-current triac or a pair of silicon controlled rectifiers (SCR) connected in the "anti-parallel" mode are used to trigger the voltage pulses. Approximately 120 pulses per second are produced at a voltage level of 10 to 15 KV.

DETAILED DESCRIPTION OF THE PREFERRED EMBODIMENTS

Figure 1:
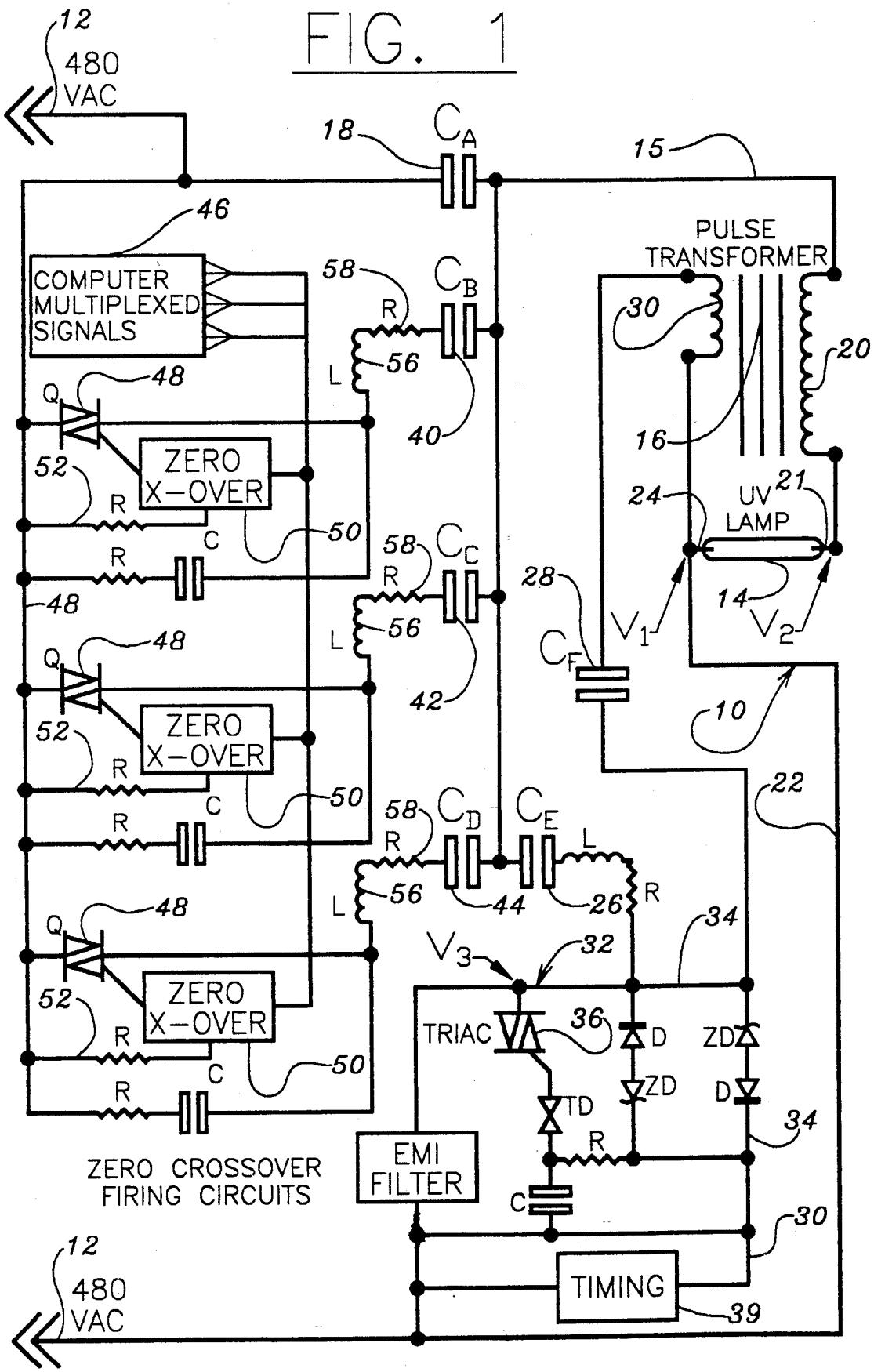
FIG. 1 is a diagrammatic view of a electronic schematic of the UV emission unit of this invention.

The quick start, ultraviolet emission unit, or UV unit, of this invention is shown schematically in FIG. 1 designated by the reference numeral 10. The UV unit 10 is connected to a 480 VAC power source 12 to provide an operating line voltage sufficient to initiate operation of an electrode-type, mercury UV lamp 14. It is to be understood that the system described is suitable for a twelve inch long lamp and that variations are to be expected for larger or smaller lamps, particularly in custom applications.

The 480 VAC power source provides supply voltage to the main line 15 of a pulse transformer 16 through a protective line capacitor (Ca) 18. The a.c. power is fed through the secondary 20 of the pulse transformer 16 to power one electrode 21 of the UV lamp 14 during operation. The reference voltage line 22 is connected to the other electrode. Ultraviolet radiation is emitted when the mercury in the lamp is vaporized and the lamp is conducting.

Capacitor (Ce) 26 and capacitor (Cf) 28 operate as voltage dividers, such that the voltage at V3 is approximately 240 volts. The pulse transformer 16 has a primary 30 connected to the high capacity capacitor (Cf) 28, which on discharge passes the comparatively low voltage, high current pulse through the primary 30. The pulse is stepped-up at a 20:1 ratio to a high voltage spike by the secondary 20. The high voltage spike combines with the line voltage being supplied through the secondary to the lamp electrode 21 on start-up. The high-voltage generates arcing on each half-wave of the alternating current instantly ionizing the filler gas and vaporizing condensed mercury. The voltage potential of the combined supply and spike voltage is sufficient to reactivate emissions regardless of the vaporization condition of mercury on restart.

A trigger circuit 32 having a protected zener diode subcircuit 34, and a high-current triac 36, is designed to trigger the high energy discharge of capacitor (Cf) 28 at the peak potential of the AC waveform during each half-cycle. When the triac triggers, the capacitor instantly discharges through the primary 30 producing a single high voltage spike in the secondary 20 of the pulse transformer 16. An EMI filter 37 prevents interference signals during switching operations from entering the power supply.

Figure 2:
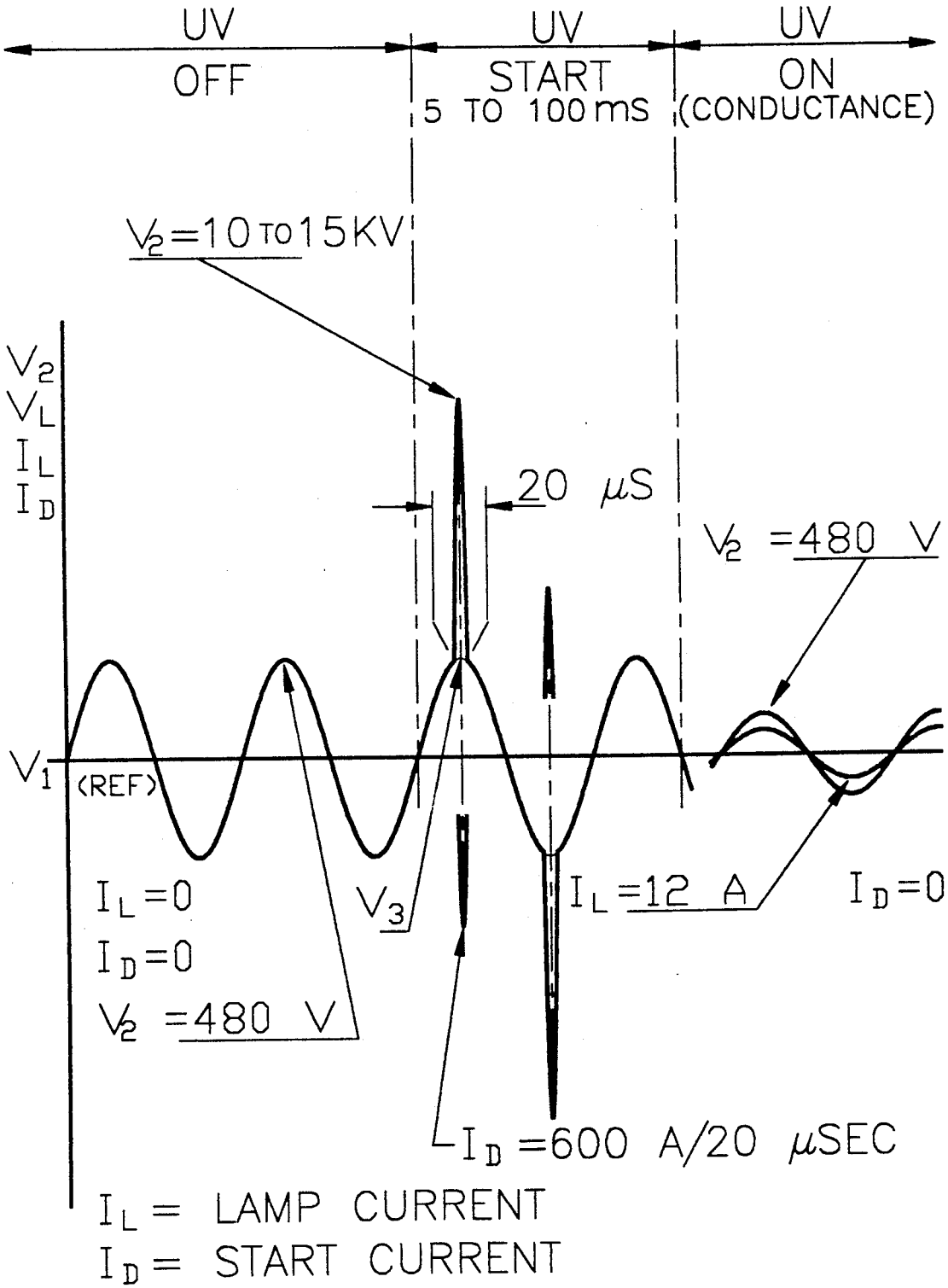
FIG. 2 is a diagrammatic view of an electronic voltage time chart showing three phases of operation of the unit.

As shown graphically in FIG. 2, the spike at a current level of approximately 600 amps/200 sec. is added to the peak of each sinusoidal half-cycle during start-up. The high voltage pulses produce instantaneous ionization of the starting gas. When the starting plasma changes from that of the starting gas to that of the constricted mercury arc, the lamp is in operation and the supply voltage across the lamp decreases from 480 Volts to approximately 200 Volts (for a 12" lamp). This voltage drop is also sensed and the pulse circuit is automatically disconnected. A electronic timing circuit 39 also disables the "firing" circuit after 5 seconds of operation if the lamp fails to start, and originates an alarm condition.

As seen in FIG. 2, as voltage is applied to the UV lamp, the potential difference between V2 and V1 is 480 Volts. Due to the very high impedance of the cold (or hot) lamp, the lamp current (Il) is zero. Capacitors (Ce) 26 and (Cf) 28 are voltage dividers so the potential at V3 is ½ of the main voltage or approximately 240 Volts. On start-up, the triac firing circuit senses the maximum cycle voltage at V3 (peak voltage) and fires the triac 36, discharging capacitor (Cf) 28 through the primary winding of the pulse transformer 16, causing a very high voltage spike on the secondary winding at the top of the main voltage sinusoid, with an attendant high current spike (estimated at 600 Amps for 20 microseconds). These resultant voltage/current spikes are fed to the lamp electrodes, once every half cycle. The voltage pulses are of the same polarity as the main AC voltage. In just a few cycles, the repeated discharge of very short duration, but very high voltage and current spikes, through the lamp electrodes, causes the gas within the lamp to ionize, and the lamp to conduct. After the lamp starts to conduct, V2 will decrease to a value of approximately 200 Volts (for a 12" UV Lamp) and current will stabilize at approximately 12 Amps. At this point, the firing circuit is disabled and the lamp is being supplied by the main voltage line with a series connected capacitance provided by a selected combination of capacitors (Ca, Cb, Cc, and Cd), 18, 40, 42, and 44.

At start-up or restart, a central processor 46 commands that the full series capacitance be used, thereby aiding in the start of the lamp. Once the lamp is conducting, power is reduced by removing capacitance from the circuit, by disconnecting capacitors Cb, Cc, and Cd, through the appropriate triac switching.

A triac switching circuit 48 removes and adds capacitance impedance to the circuit under control of the central processor. The triac switching elements 48 are operated by using a relay 50 to provide the gate signal required to turn the triac elements on. A 100 ohm resistor 52 between the gate relay 50 and the main voltage line supplies the necessary 10 mA for turning the triac element on. To protect the triac from the high-voltage spike when triggered, a change in state of the triac is timed to occur at "zero crossover". Therefore, just as the RMS sinusoid goes above the zero threshold the central processor electronically actuates the relay to activate switching. The high current, high voltage spike produced by switching added capacitance into the circuit is snubbed by a 5 mH choke 56 and a 2 watt resistor 58.

Using a matrix table six separate power levels can be produced by selective combination of three appropriately rated capacitors. By using an additional number of capacitor subcircuits, a greater number of steps from a sustaining current at about 30% of maximum current to maximum current. For example, if four triac elements are used, a total of 12 power outputs will be possible, etc. Use of a microprocessor for switching allows for convenient manual entry and automatic selection. For example, a particular commercial process may require radiation at 80% of maximum. A user would enter the job specification and any interrupt, after switching the maximum power for restart would automatically drop to the job set when restart is completed.

The quick starting ultraviolet emission unit of this invention dispenses with shutters, expensive mercury switches and allows for compact housing enabling the unit to be an add-on component in a variety of processing equipment with minimum space allowance.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

I claim:

1. A quick start ultraviolet emission unit comprising:
an elongated, electrode-type, mercury-filled, arc lamp having spaced end electrodes;
an electrical power supply means connected to an alternating current power source and to each end electrode of the arc lamp for powering the lamp with an alternating current having a sinusoidal cycle;
pulse generating, circuit means connected to said power supply means for generating a high current, high voltage, electrical pulse added to the alternating current to the lamp during start-up and restart; and
trigger circuit means connected to the pulse generating circuit means for triggering generated high current, high voltage electrical pulses at the peak potential in the sinusoidal cycle of the alternating current from the power supply, wherein the high voltage electrical pulse is of the same polarity as the peak potential in the sinusoidal cycle of the alternating current.

2. The quick start, ultraviolet emission unit of claim 1 wherein the pulse generating circuit means connected to the power supply means includes a pulse transformer having a primary and a secondary with current from the power supply passing through the secondary of the pulse transformer to the lamp, and wherein the pulse generating circuit means includes a high current, low voltage, electrical pulse generating subcircuit means connected to the primary of the pulse transformer for producing a high voltage, high current electrical pulse, with the triggering means having electrical sensing means for triggering the pulse generating subcircuit means at the peak potential in each half cycle of the sinusoidal cycle of the alternating current from the power supply.

3. The quick start ultraviolet emission unit of claim 1 wherein the electrical pulse generating means includes a capacitor and a high current triac having a zener trigger control means for triggering the triac and discharging the capacitor through the secondary of the pulse transformer.

4. The quick start ultraviolet emission unit of claim 3 wherein the electrical pulse generating, subcircuit means includes a timer control means for deactivating the electrical pulse generating subcircuit means after a predetermined time period.

5. The quick start ultraviolet emission unit of claim 4 wherein the electrical pulse generating, subcircuit means includes a voltage sensing means for sensing voltage drop across the lamp and deactivating the electrical pulse generating subcircuit means after a predetermined voltage drop.

6. The quick start, ultraviolet emission unit of claim 1, wherein the electrical power supply means includes electronic switching means for selectively regulating the power supply to the lamp.

7. The quick start, ultraviolet emission unit of claim 6, wherein the power supply means includes a line capacitor and wherein the electronic switching means includes at least one additional line capacitor, with a triac switching circuit connected to the additional capacitor having circuit control means for switching the additional capacitors into and out of series with the line capacitor of the power supply means.

8. The quick start ultraviolet emission unit of claim 3 wherein the zener trigger control means includes a switching circuit means for switching the state of the triac at zero crossover int eh sinusoidal cycle of the alternating current.

9. A quick start ultravoilet emission unit comprising:
an elongated, electrode-type, mercury-filled, arc lamp having spaced end electrodes;
an electrical power supply means connected to an alternating current power source and to each end electrode of the arc lamp for powering the lamp with an alternating current having a sinusoidal cycle;
pulse generating, circuit means connected to said power supply means for generating a high current, high voltage, electrical pulse added to the alternating current to the lamp during start-up and restart; and
trigger circuit means connected to the pulse generating circuit means for triggering generated high current, high voltage electrical pulses at the peak potential in the sinusoidal cycle of the alternating current from the power supply;
wherein the electrical power supply means includes electronic switching means for selectively regulating the power supply to the lamp;
wherein the power supply means includes a line capacitor; wherein the electronic switching means includes at least one additional line capacitor, with a triac switching circuit connected to the additional capacitor having circuit control means for switching the additional capacitors into and out of series with the line capacitor of the power supply means; and
wherein the circuit control means includes a central processor and a relay means connected to the central processor for switching triggering current to the triac switching circuit.

* * * * *